US007934715B2

(12) United States Patent
Trudeau

(10) Patent No.: US 7,934,715 B2
(45) Date of Patent: May 3, 2011

(54) ARRANGEMENT FOR MOUNTING AN INGESTION ASSEMBLY OF A SINGULATING APPARATUS

(75) Inventor: Joseph A. Trudeau, Watertown, CT (US)

(73) Assignee: Pitney Bowes Inc., Stamford, CT (US)

( * ) Notice: Subject to any disclaimer, the term of this patent is extended or adjusted under 35 U.S.C. 154(b) by 281 days.

(21) Appl. No.: 12/276,534

(22) Filed: Nov. 24, 2008

(65) Prior Publication Data

US 2010/0127449 A1 May 27, 2010

(51) Int. Cl.
*B65H 5/00* (2006.01)

(52) U.S. Cl. ..... 271/2

(58) Field of Classification Search ..... 271/273, 271/274, 2, 135, 137, 117; 248/637, 646, 248/674, 274.1
See application file for complete search history.

(56) References Cited

U.S. PATENT DOCUMENTS 5,265,866 A * 11/1993 Greive ..... 271/225
6,598,870 B2 * 7/2003 Hanano ..... 271/138
6,779,792 B2 * 8/2004 Lyga et al. ..... 271/273
7,789,387 B2 * 9/2010 Trudeau et al. ..... 271/273
2003/0141650 A1 * 7/2003 Coret et al. ..... 271/34
2004/0080103 A1 * 4/2004 Lyga et al. ..... 271/273

* cited by examiner

*Primary Examiner* — Kaitlin S Joerger
(74) *Attorney, Agent, or Firm* — Brian A. Collins; Charles R. Malandra, Jr.

(57) ABSTRACT

An arrangement for mounting an ingestion assembly within a singulating apparatus operative to singulate and convey sheet material along a feed path. The mounting arrangement includes a radial bearing pivotally mounting the ingestion assembly to a stationary support structure of the singulating apparatus. The radial bearing is operative to pivot the singulating assembly from an operating position to an idle position about a pivot axis which is substantially orthogonal to the feed path of the sheet material. The mounting arrangement also includes an over-center mechanism disposed in combination with the radial bearing for biasing the ingestion assembly about the pivot axis such that the ingestion assembly is forcibly held in each of the operating and idle positions. Optimum space utilization and ease of use is provided by the radial bearing which cantilever mounts the ingestion assembly to the singulating apparatus.

17 Claims, 4 Drawing Sheets

ARRANGEMENT FOR MOUNTING AN INGESTION ASSEMBLY OF A SINGULATING APPARATUS

TECHNICAL FIELD

This invention relates to singulating sheet material/media, and more particularly, to a new and useful arrangement for mounting an ingestion assembly of a singulating module/apparatus.

BACKGROUND ART

Material handling apparatus such as mailpiece inserters or mailing machines commonly employ rollers and/or belts for transporting and separating/singulating sheet material. In the context used herein, "sheet material" is used generically to describe any substantially flat, two-dimensional media such as sheets of paper, postcards, laminate, mailpieces, etc. Oftentimes, a combination of belts and rollers (fixed or rotating) are employed, e.g., a roller opposing a set of belts, to separate/singulate individual sheets from a stack of sheet material.

A common singulating apparatus, used in a variety mailpiece inserters, employs one or more horizontal conveyor belts/rollers moving in one direction along a transport deck and at least one roller disposed above the belts to form a V-shaped ingestion area or throat between the rollers and the belt(s). In mailpiece inserters it is common to employ a stationary stone roller disposed a fixed distance above a conveyor belt/roller to define a gap which permits the passage of the lowermost sheet of material from a stack of sheet material. Alternatively, a drive roller may oppose the stone roller, immediately downstream of a conveyor belt to form the V-shaped throat for accepting sheet material from the conveyor belt. In other sheet handling apparatus, such as a mailing machine, a roller is similarly positioned above a conveyor belt/roller but is driven at a speed, or in a direction, which opposes the motion of the conveyor belt/roller to facilitate singulation of sheet of material. The roller(s), disposed above the driven belt/roller(s), are commonly mounted within a housing which includes an ingestion guide which is operative to prevent all but the lowermost sheets of a stack from approaching the ingestion throat, and an adjustment mechanism operative to define the singulation gap, i.e., the distance between the upper roller(s) and the underlying conveyor belt/roller, to accommodate sheets/mailpieces of various thickness. Hereinafter, the roller(s), housing, ingestion guide and adjustment mechanism will collectively be referred to as an "ingestion assembly" inasmuch as these elements are principally responsible for the ingestion/singulation of sheet material.

A variety of factors associated with the geometry and arrangement of the ingestion assembly can be difficult to control and/or to optimize the effectiveness of the singulating apparatus. For example, the ingestion assembly roller(s) must be precisely aligned with the underlying drive belt(s)/roller(s) to ensure that sheet material is reliably singulated, i.e., without skewing or damage to the singulated sheets. Furthermore, the singulation gap must be reliably and accurately controlled/maintained to reliably singulate the sheet material. That is, the ingestion assembly must be rigidly mounted above the drive belt(s)/roller(s) to maintain the singulation gap without deviation/variation. Furthermore, the ingestion assembly must be removable/detachable to access jammed sheet material from, or for the repair/maintenance of the underlying belt(s)/roller(s) of, the singulating apparatus.

Prior art ingestion assemblies are typically mounted to the deck of the singulating apparatus by a rigid box structure which spans laterally across the feed path, i.e., from one side of the singulating apparatus to the other. The box structure is typically fabricated from a high strength steel or aluminum and comprises several, high stiffness, cross members which rigidly suspend the ingestion assembly above the conveyor belt(s)/roller(s). Furthermore, the box structure and deck include precise mating surfaces, i.e., machined surfaces, to ensure accurate placement of the ingestion assembly. Finally, the box structure is attached to the deck by large set-screws/knobs which enable the structure to be detached and reassembled should a jam occur, or when repair/maintenance of the ingestion assembly or underlying belt(s)/roller(s) is required.

While this mounting arrangement provides the necessary rigidity, accuracy and flexibility to perform repair/maintenance, the box structure of the prior art is costly to fabricate and is cumbersome to assembly/reassemble, i.e., for such routine and, possibly frequent, activities associated with jam access and repair/maintenance.

A need, therefore, exists for a mounting arrangement which rigidly and accurately positions the ingestion assembly above the underlying conveyor belt(s)/roller(s) of the singulating apparatus while facilitating access, repair and maintenance.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

SUMMARY OF THE INVENTION

An arrangement is provided for mounting an ingestion assembly within a singulating apparatus operative to singulate and convey sheet material along a feed path. The mounting arrangement includes a radial bearing pivotally mounting the ingestion assembly to a stationary support structure of the singulating apparatus. The radial bearing is operative to pivot the singulating assembly from an operating position to an idle position about a pivot axis which is substantially orthogonal to the feed path of the sheet material. The mounting arrangement also includes an over-center mechanism disposed in combination with the radial bearing for biasing the ingestion assembly about the pivot axis such that the ingestion assembly is forcibly held in each of the operating and idle positions. Optimum space utilization and ease of use is provided by the radial bearing which cantilever mounts the ingestion assembly to the singulating apparatus.

DETAILED DESCRIPTION

The mounting arrangement of the present invention is described in the context of a singulating apparatus for mailing machines, though the invention is applicable to any singulation module/assembly for separating sheet material. For example, other sheet material handling apparatus which require separation of individual sheets from a stack of sheets include mailpiece sorting machines, copying and facsimile machines, etc. Furthermore, while the mounting arrangement is described in the context of an ingestion assembly having various components and assemblies for singulating sheet material, the ingestion assembly may employ any of variety of features which function to singulated/separate sheet material from a stack of material. For example, while the ingestion assembly includes a stone roller for singulating sheet material, other singulating rollers may be employed. For example, singulating rollers which rotate in a direction opposing the movement of the underlying conveyor belts, or in the same direction but at a reduced velocity relative thereto, may be employed.

Figure 1:
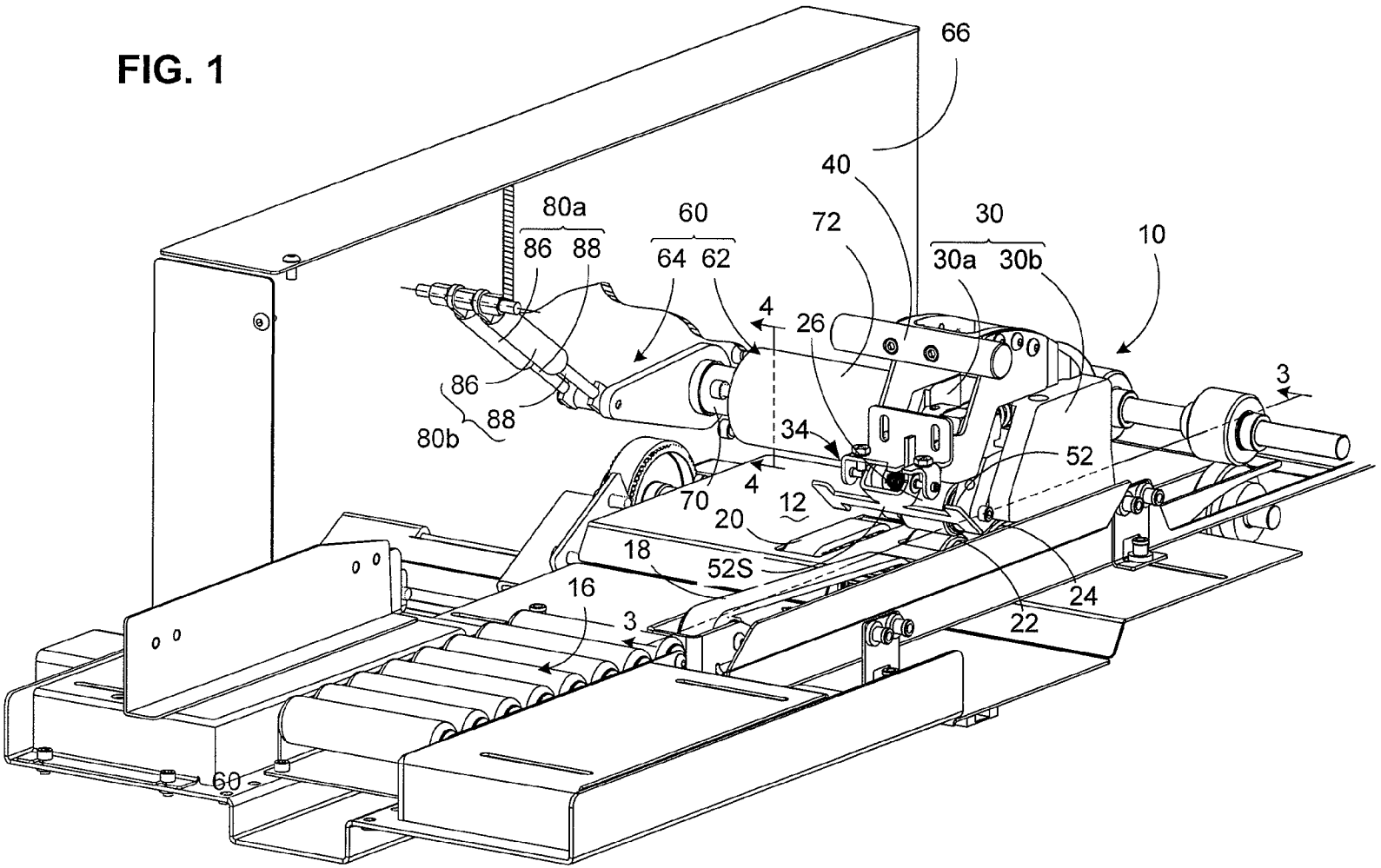
FIG. 1 is a partially broken-away perspective view of an arrangement for mounting an ingestion assembly to a singulating apparatus including a cantilevered radial bearing for pivotally mounting the ingestion assembly to a stationary support structure, e.g., a side wall structure, of the singulating apparatus.
Figure 2:
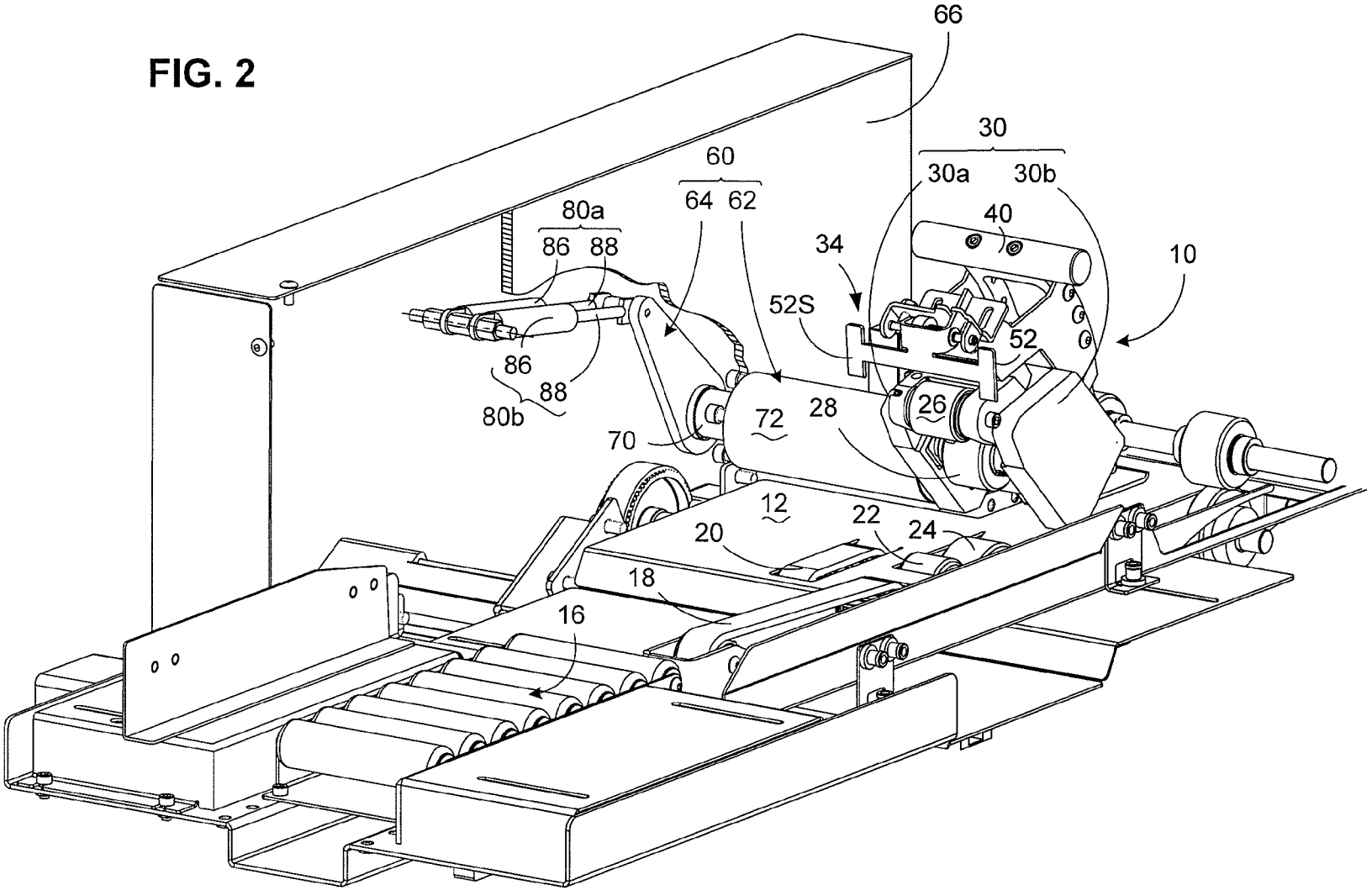
FIG. 2 depicts a partially broken-away perspective view of the mounting arrangement wherein the ingestion assembly is pivoted upwardly and includes an over-center mechanism operative to bias the ingestion assembly into idle and operational positions.
Figure 3:
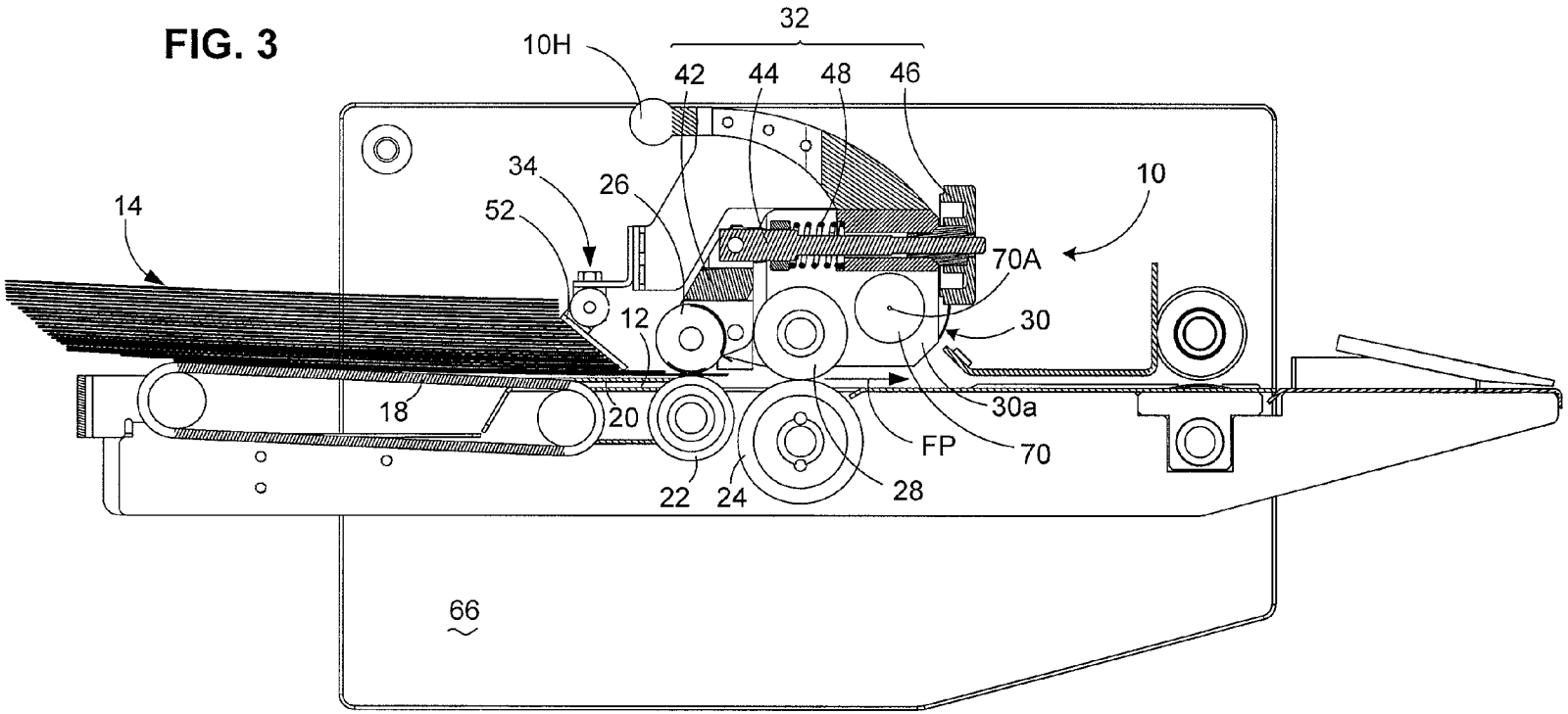
FIG. 3 is a cross-sectional view taken substantially along line 3-3 of FIG. 1 wherein the ingestion assembly includes a stone roller disposed in opposed relation to an underlying drive roller, a housing assembly for fixedly mounting the stone roller, an adjustment mechanism for varying a singulation gap between the stone and drive rollers, and an ingestion guide disposed upstream of the stone and drive rollers.

Referring to FIGS. 1, 2 and 3, an ingestion assembly 10 mounts above a transport deck 12 which conveys a stack of sheet material 14 (see FIG. 3) along a feed path FP. The transport deck 12 accepts the sheet material 14 from a plurality of input rollers 16 (see FIGS. 1 and 2) upstream of the deck 12 and includes a primary input conveyor belt 18, a secondary input conveyor belt 20 adjacent and downstream of the primary input conveyor belt 18, a drive roller 22 downstream of the input conveyor belts 18, 20 and a take-away roller 24. In FIGS. 1 and 3, the ingestion assembly 10 is shown in an operating position, i.e., for receiving the stack of sheet material 14, while, in FIG. 2, the ingestion assembly 10 is shown in an idle position, i.e., pivoted upwardly to facilitate the removal of debris, jammed sheet material, and repair/maintenance.

The ingestion assembly 10 establishes the upper bounds of the ingestion area and includes: (i) a stone roller 26 disposed in opposed relation to the underlying drive roller 22, (ii) an idler roller 28, (iii) a housing assembly 30 for mounting the stone and idler rollers 26, 28, (iv) an adjustment mechanism 32 for varying a singulation gap between the drive and stone rollers 22, 26, and (v) an ingestion guide 34 disposed upstream of the drive and stone rollers 22, 26. The stone roller 26 is fixedly mounted about a first shaft 36 within the housing 26 while the idler roller 28 is mounted for rotation about a second shaft 38. The housing assembly 30 includes side plates 30*a*, 30*b* which are integrated by the shafts 36, 38 in addition to cross members (not viewable in FIGS. 1 through 3) which provide additional structural integrity. Additionally, the housing 30 includes a forward bell crank block 44 which is mounted between the side plates 30*a*, 30*b* about a third shaft 46. The bell crank block 44 mounts the stone roller 26 and serves to raise or lower the roller 26 by pivoting about the third shaft 46. A T-shaped handle 40 is mounted to an upper portion of the housing 30 and serves to facilitate rotation of the ingestion assembly 10 into and out of the operating and idle positions, seen in FIGS. 1 and 2, respectively.

In FIG. 3, the adjustment mechanism 32 includes a threaded rod 42 disposed through an elongate aperture of the housing 30 which extends from the bell crank block 44 to an opening in an aft end of the housing 30. The threaded rod 42 is pin mounted to the bell crank block 44 at a forward end thereof and threadably engages an adjustment knob 46 at the aft end. Furthermore, the threaded rod 42 is biased forwardly by an internal coil spring 48 and may be displaced, i.e., forward and aft, by turning the adjustment knob 46, i.e., against the biasing force of the spring 48. By turning the knob 46 in one direction, the threaded rod 42 is displaced forwardly to rotate the bell crank block 44 in a counterclockwise direction about the shaft 46. As a result, the stone roller 26 is displaced downwardly to decrease the size of the singulation gap. Turning the adjustment knob 46 in the opposite direction causes the rod 42 to be drawn aft against the biasing force of the coil spring 48. Consequently, the bell crank block 44 rotates in a clockwise direction to lift the stone roller 26 and increase the singulation gap.

The ingestion guide 34 improves the reliability of the singulating apparatus 10 by allowing only a few sheets, i.e., the lowermost sheets of the stack 14, to enter the ingestion area. More specifically, the ingestion guide 34 includes a moveable guide plate 52 which is pivotally mounted to a forward end of the housing 30, i.e., upstream of the stone roller 26. The guide plate 52 defines an inclined surface 52S (best seen in FIGS. 1 and 2) which initiates shingling of the stack 14 (FIG. 3) to prevent the stack 14 from wedging beneath, and lifting, the stone roller 26. With respect to the latter, it will be appreciated that forces tending to lift the stone roller 26 may increase the singulation gap and allow more than one sheet to pass under the stone roller 26.

According to the present invention, an arrangement 60 is provided for mounting the ingestion assembly 10 which (i) rigidly suspends the ingestion assembly 10 above the transport deck 12, i.e., the underlying conveyor belt(s)/roller(s) 18, 20, 22, 24, (i) permits rotation of the ingestion assembly from an operating position (FIG. 1) to and idle position (FIG. 2) to enable rapid access to the ingestion area, i.e., the area between the ingestion assembly 10 and the conveyor belt(s)/roller(s) 18, 20, 22, 24, and positively holds the ingestion assembly 10 in the operating and idle positions. More specifically, the mounting arrangement 60 includes a radial bearing mount 62 and an over-center biasing mechanism 64. The radial bearing mount 62 provides a cantilevered support, i.e., to one side of the ingestion assembly, which provides rigidly and easy access to the underlying ingestion area. In the context used herein, the term "cantilevered" means that the ingestion assembly 10 is suspended from a mounting structure which is rigidly affixed, at one end only, to a support structure. The over-center biasing mechanism 64 is coupled to the radial bearing mount 62 and forcibly holds the ingestion assembly 10 in each of the operational and idle positions. Each of these assemblies/components will be described in greater detail in subsequent paragraphs.

Figure 4:
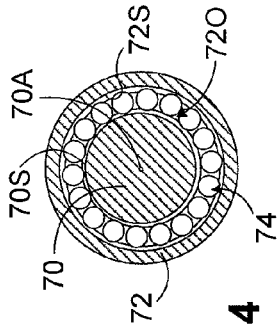
FIG. 4 is a cross-sectional view taken substantially along line 4-4 of FIG. 1 depicting a view through the cantilevered radial bearing mount.

In FIGS. 1 through 4, the radial bearing mount 62 couples the ingestion assembly 10 to a first support structure of the singulating apparatus, i.e., a vertical side wall structure 66 of the singulating apparatus. In FIGS. 3 and 4, the radial bearing mount 62 includes first and second cylindrical members 70, 72, which are co-axially aligned about a pivot axis 70A which is substantially orthogonal to the feed path FP of the sheet material 14. The first cylindrical member 70 is mounted at a first end to the housing 30 of the ingestion assembly 10 and extends through a cylindrical orifice 72O in the second cylindrical member 72. The second cylindrical member 72 is mounted at one end to a first end to the vertical support structure 66 and is disposed over, or envelopes, the first cylindrical member 70.

The radial bearing mount 62, furthermore, includes a pair of bearings 74 (only one is shown in FIG. 4) which are disposed between the outer and inner cylindrical surfaces walls 70S, 72S of the first and second cylindrical members 70, 72, and permit rotation of the first cylindrical member 70 relative to the second cylindrical member 72 about the pivot axis 70A. In the illustrated embodiment, each bearing 74 may include a plurality of spherical balls 76 disposed in inner and outer bearing races 68*a*, 68*b*. While a ball-bearing assembly is described and is shown in FIG. 4, the bearings 64 may be any roller, anti-friction or journal-type bearings, i.e., bearings which principally react radial loads and permit relative motion about an axis of rotation.

The radial bearing mount 62 provides a high degree of bending stiffness along the pivot axis 70A for mounting the ingestion assembly 10 without flexure or deformation while in use. In the described embodiment, the radial bearing mount 62 is fabricated from a high stiffness metal such as stainless steel, aluminum or aluminum alloy, and has a diameter of between about one inch (1") to about one and one-half inches (1½"). Furthermore, the bearings 74 are spaced-apart, i.e., disposed at each end of the cylindrical members 70, 72 to provide bending moment stability along the pivot axis 70A.

In another embodiment of the invention, the radial bearing mount 62 may include a pair of drill bushings disposed in combination with a lapped fit pivot rod (not shown). The pivot rod extends the length of the pivot axis 70A and provides the requisite rigidity with minimal radial play to maintain the accuracy of the ingestion assembly 10, i.e., maintain the singulation gap between the drive and stone rollers 22, 26. The large separation distance between the drill bushings provides added journaling for bending moment stability.

Figure 5:
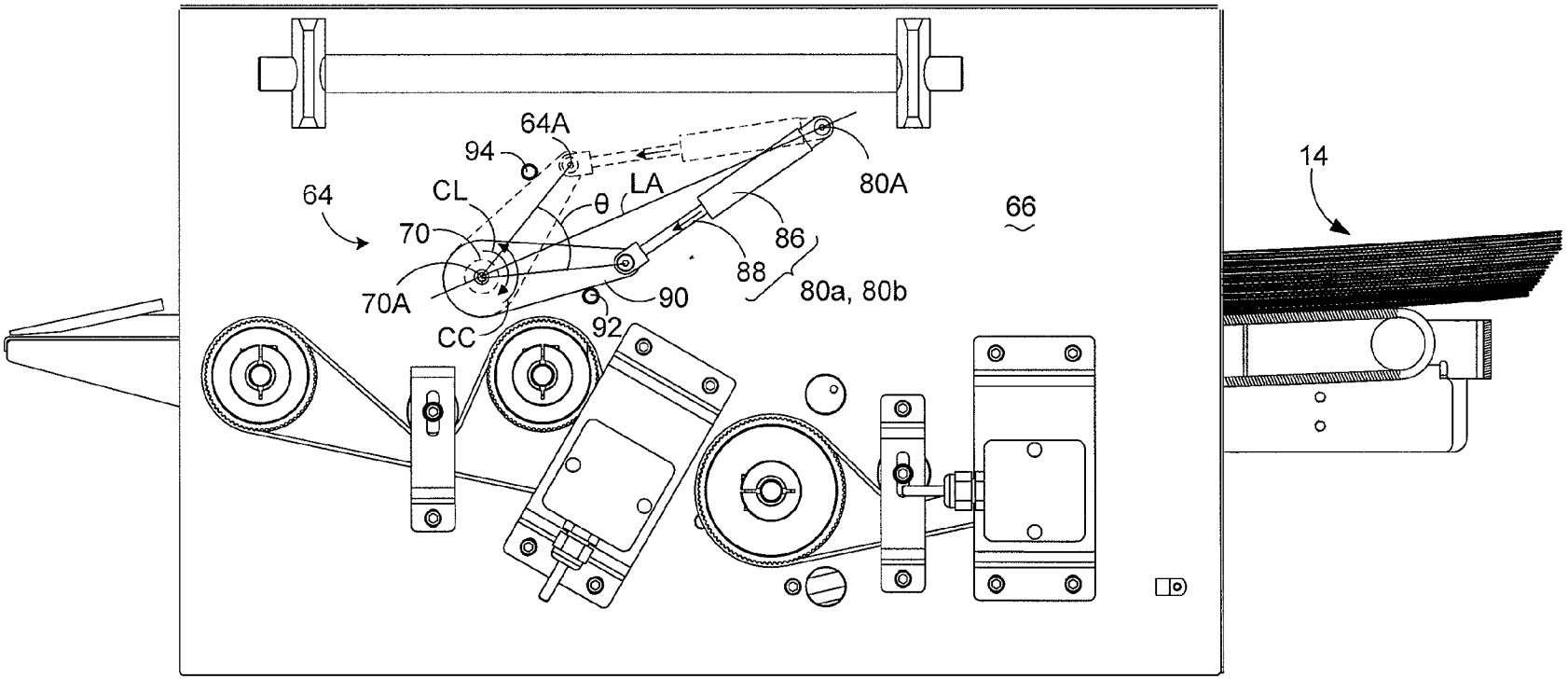
FIG. 5 is a rear profile view of the over-center mechanism wherein an extensible strut is adapted to apply a biasing moment about the pivot axis of the ingestion assembly to urge and retain the ingestion assembly into one of idle or operating positions.

In FIGS. 1, 2, and 5, the over-center biasing mechanism 64 includes at least one telescoping strut 80 mounting to a second support structure of the singulating apparatus. In the described embodiment, the first and secondary support structures are integrated by a common vertical side wall structure 66, however, it should be appreciated that the stationary support structures may be distinct and separate elements of the singulating apparatus. The telescoping strut 80 is pivot mounted to the side wall structure 66 at one end thereof about a second pivot axis 80A and coupled to the radial bearing mount 62 at the other end. In the described embodiment, an actuation arm 82 is rigidly affixed to the second end of the first cylindrical member 70, i.e., an end which passes through the second cylindrical member 72 of the radial bearing mount 62 passing and the side-wall structure 66 of the singulating apparatus. The second end is also opposite the first end which mounts to the ingestion assembly 10.

In the described embodiment, the over-center biasing mechanism 64 includes a pair of telescoping struts 80*a*, 80*b* disposed in juxtaposed relation (best seen in the perspective views of FIG. 1 and FIG. 2) and a single actuation arm 82. Each of the telescoping struts 80*a*, 80*b* includes a pneumatic or gas chamber 82 which is filled with a compressible fluid, e.g., air, under pressure. An extensible rod 84 is disposed in combination with the gas chamber and extends under the pressure applied by the fluid. More specifically, the pressurized fluid causes the rod 84 to fully extend and is compressed when the rod 84 is retracted. With respect to the latter, the rod 84 is fitted with a ringed-piston (not shown) which is sealed against the internal cylindrical walls of the gas cylinder 82 such that when the rod 84 is forced to retract, pressure builds within the fluid. Consequently, the forces which counteract the motion increases as a function of the displacement, in much the same way forces governing the reaction of a coil spring are a function of its displacement.

The actuation arm 82 is pivotally mounted to each actuation rod 84 of the telescoping struts 80*a*, 80*b* at one end and rigidly affixed to the first cylindrical member 70 at the opposite end. Furthermore, the actuation arm 82 projects radially from the pivot axis 70A of the radial bearing mount.62. Moreover, the actuation arm 82 is connected to the first cylindrical member 70 on an opposite side of the support structure 66, i.e., opposite the ingestion assembly 10.

In operation, when the singulating apparatus is prepared to feed sheet material 14, an operator rotates the handle 40 (affixed to the housing 30 of the ingestion assembly 10) downwardly to rotationally displace the ingestion assembly 10 into the operating position (shown in FIG. 1). Rotation of the ingestion assembly 10 effects rotation of the first cylindrical member 70 about the pivot axis 70A and causes the actuation arm 82 of the over-center mechanism 64 to rotate through an angle θ (see FIG. 5). In the described embodiment, the angle θ is about forty-five degrees (45°), however, the total angular displacement may increase or decrease depending upon the amount of desired access beneath the ingestion assembly 10. As the actuation arm 82 is displaced in a clockwise direction CL about the pivot axis 70A, the over-center mechanism 64 crosses a line of action LA which passes through the pivot axes 70A, 80A of the radial bearing mount 62 and the telescoping struts 80*a*, 80*b*, respectively. During rotational displacement, the telescoping struts 80*a*, 80*b* are initially compressed, i.e., causing the actuation rod 88 to compress the fluid within the gas chambers 86. The pressurized fluid forms a gas/air spring such that, when the actuation arm 82 crosses the line of action LA, the telescoping struts 80*a*, 80*b* of the over-center mechanism 64 expand to apply a biasing moment to the radial bearing mount 62. That is, the telescoping struts 80*a*, 80*b* apply a biasing moment about the pivot axis 70A through the actuation arm 82. As a consequence, the actuation arm 92 rotates until reaching a geometric or physical stop and the ingestion assembly 10 is forcibly urged into the operational position (shown in FIG. 1). In the described embodiment, the actuation arm 82 is urged against a stop pin 92, however, a stop disposed internally of the struts 80*a*, 80*b*, may be employed to urge the ingestion assembly 10 into its operational position. In the operational position, the ingestion assembly 10 is ready to singulate sheet material along the feed path and the singulation gap, i.e., the space between the drive and stone rollers 22, 26 (see FIG. 3), may then be controlled by the adjustment mechanism 32, described supra.

When the singulating apparatus is opened for jam access, repair or maintenance, an operator rotates the handle 40 upwardly to rotationally displace the ingestion assembly 10 into the idle position (shown in FIG. 2). Rotation of the ingestion assembly 10 effects rotation of the first cylindrical member 70 in a counterclockwise direction CC about the pivot axis 70A. As a result, the over-center mechanism 64 crosses the line of action LA to, once again, compress and pressurize the fluid within the telescoping struts 80*a*, 80*b*. Similar to the motion described above, the telescoping struts 80*a*, 80*b* expand to apply a biasing moment to the radial bearing mount 62. As a consequence, the actuation arm 82 rotates until reaching a second stop, e.g., a second stop pin 94, and the ingestion assembly 10 is forcibly urged into the idle position. In the idle position, areas prone to sheet material jams may be accessed and the various belt(s)/roller(s) of the singulating apparatus, 18, 20, 22, 24, 26, 28, may be inspected for repair and maintenance.

Although the invention has been described with respect to a preferred embodiment thereof, it will be understood by those skilled in the art that the foregoing and various other changes, omissions and deviations in the form and detail thereof may be made without departing from the scope of this invention. For example, while the mounting arrangement 10 of the present invention includes an over-center mechanism 64 having a pair of juxtaposed telescoping struts 80*a*, 80*b*, a single telescoping strut may be employed to apply the biasing moments about the radial bearing mount 62. In the described embodiment, the side-by-side struts 80 increase the biasing force applied to the radial bearing mount 62 without changing the geometry of the over-center mechanism 64 or increasing the profile dimension thereof. Furthermore, the described embodiment employs a side-wall structure 66 forming a solid vertical plane which is disposed to a side of, and vertically upward from, the transport deck 12. While a single planar structure may simplify manufacture and assembly, it will be appreciated that other support structures may be contemplated, e.g., a first structural support for the radial bearing mount 62 and a second structural support for mounting the over-center mechanism 64.

What is claimed is:

1. A mounting arrangement for mounting an ingestion assembly within a singulating apparatus, the singulating apparatus operative to singulate sheet material which is fed along a feed path, the mounting arrangement comprising:

a radial bearing mount connecting the ingestion assembly to a support structure of the singulating apparatus, the radial bearing mount pivotally mounting about a pivot axis substantially orthogonal to the sheet material feed path and operative to pivot the ingestion assembly from an operating position to an idle position; and an over-center mechanism coupled to the radial bearing mount for biasing the ingestion assembly about the pivot axis such that the ingestion assembly is forcibly held in each of the operating and idle positions, the over-center mechanism including at least one telescoping strut pivotally mounting about a pivot axis to a support structure of the singulating apparatus and defining a line of action passing through the pivot axes of the radial bearing mount and the at least one telescoping strut, the line of action projecting radially from the pivot axis of the radial bearing mount, the telescoping strut operative to extend when disposed to either side of the line of action and apply a biasing moment about the pivot axis of the radial bearing mount when the strut is disposed to either side of the line of action.

2. The mounting arrangement according to claim 1 wherein the radial bearing mount is a cantilever mount.

3. The mounting arrangement according to claim 2 wherein the singulating apparatus includes a side-wall structure and wherein the cantilever mount is affixed at one end to the side-wall structure and at the other end to a side of the ingestion assembly.

4. The mounting arrangement according to claim 1 wherein the telescoping strut is an extensible strut having a gas chamber and an actuation rod, the gas chamber having a pressurized fluid therein and operative to bias the actuation rod as a function of the magnitude of pressure within the pressurized fluid.

5. The mounting arrangement according to claim 4 wherein the radial bearing mount is a cantilever mount.

6. The mounting arrangement according to claim 1 wherein the over-center mechanism includes a pair of extensible struts disposed in juxtaposed relation.

7. The mounting arrangement according to claim 1 wherein each of the telescoping struts is an extensible strut having a gas chamber and an actuation rod, the gas chamber having a pressurized fluid therein and operative to bias the actuation rod as a function of the magnitude of pressure within the pressurized fluid.

8. A method for mounting an ingestion assembly within a singulating apparatus, the singulating apparatus operative to singulate sheet material which is fed along a feed path, the method comprising the steps of:

connecting the ingestion assembly to a support structure of the singulating apparatus by a radial bearing mount, the radial bearing mount pivotally mounting about a pivot axis substantially orthogonal to the sheet material feed path and operative to pivot the ingestion assembly from an operating position to an idle position; and biasing the ingestion assembly about the pivot axis such that the ingestion assembly is forcibly held in each of the operating and idle positions, wherein the step of biasing the ingestion assembly includes the step of providing an over-center mechanism having at least one telescoping strut pivotally mounting about a pivot axis to a support structure of the singulating apparatus, the over-center mechanism defining a line of action projecting radially from the pivot axis and passing through the pivot axes of the radial bearing mount and the at least one telescoping strut, and causing the telescoping strut to extend when disposed to either side of the line of action and apply a biasing moment about the pivot axis of the radial bearing mount when the strut is disposed to either side of the line of action.

9. The method according to claim 8 wherein the step of connecting the ingestion assembly to the support structure includes the step of mounting the ingestion assembly to the support structure by a cantilever mount.

10. The method according to claim 8 wherein the step of causing the telescoping strut to extend includes the steps of: providing an extensible strut having a gas chamber and an actuation rod, pressurizing the gas chamber with a compressible fluid and biasing the actuation rod as a function of the magnitude of pressure within the pressurized fluid.

11. The method according to claim 10 wherein the step of connecting the ingestion assembly to the support structure includes the step of mounting the ingestion assembly to the support structure by a cantilever mount.

12. The method according to claim 8 wherein the step of providing an over-center mechanism having at least one telescoping strut includes the step of providing a pair of telescoping struts disposed in juxtaposed relation.

13. The method according to claim 12 wherein the step of providing a pair of telescoping struts includes the steps of providing a pair of extensible struts each having a gas chamber and an actuation rod, pressurizing the gas chamber of each with a compressible fluid and biasing the actuation rods as a function of the magnitude of pressure within the pressurized fluid.

14. A singulating apparatus comprising:

a transport deck for feeding sheet material along a feed path, an ingestion assembly disposed over the transport deck and operative to singulate the sheet material;

a side wall support structure disposed adjacent the transport deck and projecting vertically upward along one side thereof;

a radial bearing mount connecting the ingestion assembly to the side wall support structure, the radial bearing mount pivotally mounting about a pivot axis substantially orthogonal to the sheet material feed path and operative to pivot the ingestion assembly from an operating position to an idle position; and an over-center mechanism coupled to the radial bearing mount for biasing the ingestion assembly about the pivot axis such that the ingestion assembly is forcibly held in each of the operating and idle positions, wherein the over-center mechanism includes at least one telescoping strut pivotally mounting about a pivot axis to a support structure of the singulating apparatus, the over-center mechanism defining a line of action passing through the pivot axes of the radial bearing mount and the at least one telescoping strut, and projecting radially from the pivot axis of the radial bearing mount, the telescoping strut operative to extend when disposed to either side of the line of action and apply a biasing moment about the pivot axis of the radial bearing mount when the strut is disposed to either side of the line of action.

15. The singulating apparatus according to claim 14 wherein the radial bearing mount is a cantilever mount.

16. The singulating apparatus according to claim 14 wherein the telescoping strut is an extensible strut having a gas chamber and an actuation rod, the gas chamber having a pressurized fluid therein and operative to bias the actuation rod as a function of the magnitude of pressure within the pressurized fluid.

17. The singulating apparatus according to claim 14 wherein the over-center mechanism includes a pair of extensible struts disposed in juxtaposed relation.

* * * * *